US005606985A

United States Patent [19]

Battiston et al.

[11] Patent Number: 5,606,985

[45] Date of Patent: Mar. 4, 1997

[54] CRUTCH WITH ADJUSTABLE INCLINED HAND GRIP

[75] Inventors: Joseph Battiston; David Battiston, both of Chester, Va.

[73] Assignee: Tubular Fabricators Industry, Inc., Petersburg, Va.

[21] Appl. No.: 473,485

[22] Filed: Jun. 7, 1995

Related U.S. Application Data

[63] Continuation of Ser. No. 46,621, Apr. 14, 1993, abandoned, which is a continuation-in-part of Ser. No. 976,546, Nov. 16, 1992, abandoned.

[51] Int. Cl.[6] ..... A61H 3/02

[52] U.S. Cl. ..... 135/72; 135/76

[58] Field of Search ..... 135/68, 72, 76, 135/65, 66

[56] References Cited

U.S. PATENT DOCUMENTS

| | | | |
|---|---|---|---|
| 904,481 | 11/1908 | Hood | 135/72 X |
| 987,497 | 3/1911 | Shadell et al. | 135/72 X |
| 1,077,216 | 10/1913 | Bauerle | 135/72 X |
| 2,197,279 | 4/1940 | Thorssen | 135/72 X |
| 3,269,399 | 8/1966 | Smith | 135/72 |
| 3,517,678 | 6/1970 | Gilsdorf | 135/72 |
| 4,572,227 | 2/1986 | Wheeler | 135/72 |
| 4,625,743 | 12/1986 | Harker | 135/68 |

OTHER PUBLICATIONS

Product Literature—Sunrise Medical/Guardian (Brochure copyright 1990).

Product Literature—Carex Health Care Products (1995).

Product Literature—Lumex Inc.

*Primary Examiner*—Lanna Mai

*Attorney, Agent, or Firm*—Klauber & Jackson

[57] ABSTRACT

Solid (e.g. wooden) and tubular crutches, are adapted for use with standard bolt-supported hand grips, are modified for use with a bolt supported hand grip, at a desired incline for user comfort. The angle of incline, from normal lateral placement, is predetermined and the parallel spaced apart sections of the crutch are correspondingly apertured along such angle, i.e. with through apertures, to permit placement of the hand grip supporting bolt at such angle. A series of correspondingly angled apertures on the crutch bows allows for height adjustment similar to the standard laterally aligned apertures. The angled aperturing may be in addition to the lateral apertures to permit both inclined and lateral hand grip placement as desired. Alternatively, the hand grip itself is formed with an integral incline, whereby, when it is normally laterally affixed to the laterally aligned apertures of standard crutches with a standard bolt and wing nut connection, an inclined grip is provided.

4 Claims, 3 Drawing Sheets

CRUTCH WITH ADJUSTABLE INCLINED HAND GRIP

This is a continuation of co-pending U.S. application Ser. No. 08/046621, filed on Apr. 14, 1993, now abandoned, which is a continuation-in-part of co-pending U.S. patent application, Ser. No. 07/976,546 filed on Nov. 16, 1992, now abandoned.

FIELD OF THE INVENTION

This invention relates to hand grips for crutches and particularly to tubular crutches with quick release adjustable hand grips.

BACKGROUND OF THE INVENTION

Crutches, utilized by persons having leg or foot impairment, have been traditionally made of bent wood or more recently, of light weight, high strength, bent metal tubing. These crutches have generally been comprised of various interfitted components which are fixedly connected with one another to achieve a degree of rigidity and stability required in supporting the user's weight in motion, and at various angles of use during such motion. The rigid connections have usually been effected by bolts with wing nuts, for adjustability, or with non-adjustable rivets. In most of such crutches the user's weight is transferred from the initial supporting body, situated at the user's underarms, to a separate adjustable or telescoping supporting leg. The entire weight is thus placed on the bolts which provide the interconnection between the supporting body and the supporting leg.

A typical crutch (both wooden and metal tubular) comprises four separate elements in the construction of the weight supporting body. These elements include two lateral bent members (crutch bows) and a straight crutch leg which is sandwiched between them. The upper ends of the lateral bent members are fitted into recesses within an underarm rest to complete the body construction. A hand grip or support is adjustably connected to the lateral bent members to complete the crutch structure. Most of such hand grips are comprised of solid members with cores through which a bolt and wing nut connection is effected. With such bolt and wing connection, the hand grips are horizontally placed with respect to the lateral bent members for a direct straight gripping parallel to the ground. Only height adjustments are possible with the commonly utilized hand grips.

BRIEF DESCRIPTION OF THE INVENTION,

It is an object of the present invention to provide a quickly adjustable, hand grip for solid and tubular crutches.

It is a still further object of the present invention to provide such hand grip which is capable of being adjustably installed at inclines, for customized user comfort.

It is yet another object of the present invention to provide a means for modifying existing solid and tubular crutch structures for use with bolt supported hand grips whereby the hand grips can be placed at desired inclines for customized user comfort.

It is still another object of the present invention to provide a modified hand grip for use with a bolt support, which hand grip itself provides the desired inclined grip.

These and other objects, features and advantages of the present invention will become more evident from the following discussion and drawings in which:

Figure 3:
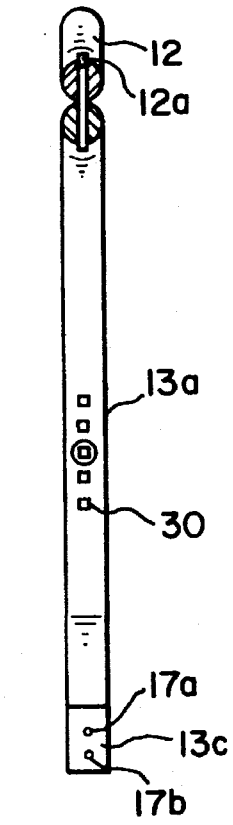
FIG. 3 is a cross sectional view taken along line 3—3 of FIG. 2.

In the co-pending parent application referred to above, a stable tubular crutch is described, having a continuous one piece body comprised of a tubular member, bent to form an elongated flattened fully enclosed ovate structure with parallel spaced apart sections. An end of the tubular member longitudinally extends from the ovate structure substantially in line with the major axis thereof. The user's weight is accordingly directly transmitted to the leg base of the crutch without intermediate weight supporting connecting elements such as bolts or rivets. The enclosed ovate structure provides full crutch stability.

The tubular member is fastened to itself in the formation of the enclosed ovate body structure preferably effected by rivets at a single connection location. Since this connection is lateral to the weight supporting axis and longitudinally extending leg, only a small portion of the user's weight is supported by this fastening and the connection is not overly subjected to stress.

To effect height adjustment, an independently adjustable straight tubular leg is interfitted with the extending end by an adjustable connection of a double detent button structure with one of the tubular leg and extending end being provided with two spring loaded buttons which fit into corresponding holes of the other, at various locations, for rapid height adjustments. The parallel, spaced apart sections of the ovate structure of tubular crutches, whether of one piece or of prior art multiple piece construction, provide the axial support for the user's body and also support a hand grip positioned therebetween and adjustably fastened thereto.

The hand grip, for use with a tubular crutch including the one piece crutch described above, as described in the co-pending application comprises a spring loaded tubular member. One side of the tubular member terminates in a short extending support element such as a short metallic rod, which is adapted to be slidingly inserted into any one of a series of apertures in the parallel sections. The other side of the tubular member terminates in a second extending support element adapted to be inserted into any one of a series of apertures in the other of the parallel sections. The apertures into which the first and second supporting elements are inserted may either be directly opposite each other, as with standard placement of hand grips, or they may be slightly offset from each other to permit the hand grip to be placed at an incline, as desired, for the comfort of the user. The second supporting element is provided with removal retarding means such as locking means, embodied therein to prevent accidental dislodgment of the hand grip.

In order to prevent undesired rotation of the hand grip, the rod element may be of non-circular cross-section to fit into corresponding non-circular apertures. Alternatively, or in addition to such rotation prevention means, a fixed yoke element with a tube engaging surface extends about either the first or second extension elements into non-rotatable engagement with the adjacent tubular parallel section.

In a preferred embodiment, the adjustable hand grip is a short tube with one end supporting an extending hook. The base of a yoke element such as a Y-shaped plastic member, with integrated metal rod (extending out of the fork of the Y) is slidingly retained, with a spring loading, in the other end of the tube. The metal rod, of non-circular cross section (to prevent rotation), and the hook are adapted to fit within any of a plurality of holes in the parallel spaced apart sections for adjustability of the hand grip. The fork of the Y is arc-shaped, to correspond to the curvature of the tube, whereby it further stabilizes the hand grip against rotation.

DETAILED DESCRIPTION OF THE INVENTION

Generally the present invention comprises a combination of crutch and adjustable hand grip, with the crutch having two parallel, spaced apart sections which are terminally connected to each other to provide an enclosed area, within which the hand grip is adapted for positioning. The hand grip is adjustably connectable to each of the spaced apart parallel sections such that a gripping incline (angularly offset from a perpendicular plane between the parallel sections) is formed. Means are provided for effecting the gripping incline with either the crutch itself embodying such means or the handgrip is configured with such means such that the gripping incline is formed, as desired.

In one embodiment of the present invention, the hand grip is utilizable with both solid (e.g. wooden) and tubular crutches, including those adapted for use with, standard bolt-supported hand grips. The standard crutches are modified for use with a bolt supported hand grip, at a desired incline for user comfort.

In such embodiment, in order to properly effect such inclined use, the angle of incline, from normal lateral placement, is predetermined and the parallel spaced apart sections of the crutch are correspondingly apertured along such angle, i.e. with through apertures, to permit placement of the hand grip supporting bolt at such angle. A series of correspondingly angled apertures on the crutch bows allows for height adjustment similar to the standard laterally aligned apertures. The angled aperturing may be in addition to the lateral corresponding apertures of standard crutches, to permit both inclined and lateral hand grip placement as desired.

In a further alternative embodiment, the hand grip itself is formed with an integral incline, whereby, when it is normally laterally affixed to the laterally aligned apertures (i.e., along the perpendicular plane) of standard crutches with a standard bolt and wing nut connection, an inclined grip is provided.

DETAILED DESCRIPTION OF THE DRAWINGS AND PREFERRED EMBODIMENT

Figure 1:
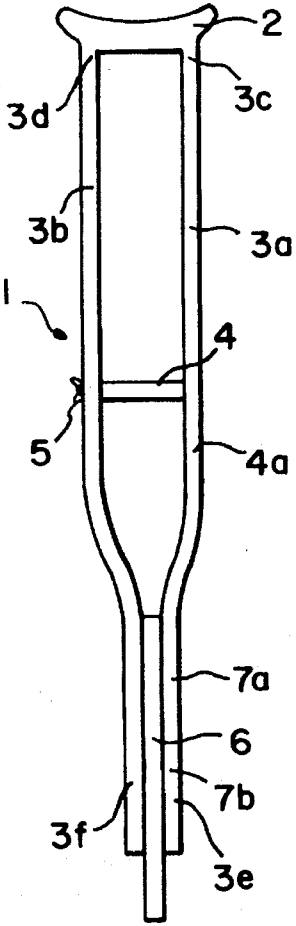
FIG. 1 PRIOR ART
FIG. 1 is a front view of a typical prior art crutch.

With specific reference to the drawings, in FIG. 1 a typical prior art crutch 1 is shown with the parts thereof which comprise weight supporting crutch body 1*a*. These separate parts include right and left bent tubes 3*a* and 3*b*, and underarm support 2, fitted onto ends 3*c* and 3*d* respectively of tubes 3*a* and 3*b*. The other ends, 3*e* and 3*f* respectively of bent tubes 3*a* and 3*b*, sandwich adjustable leg member 6, therebetween and are fixedly connected to the adjustable leg member 6 by adjustable connection members 7*a* and 7*b*, shown in phantom with dashed lines. Hand grip 4, with a through aperture, is adjustably connected to right and left bent tubes 3*a* and 3*b*. Right and left bent tubes 3*a* and 3*b* are correspondingly through-apertured at various adjustable heights for insertion of a bolt (not shown) through all of tubes 3*a*, 3*b* and hand grip 4. The bolt is fastened in place by wing nut 5. Height adjustment is effected by unthreading of the wing nut 5, removal of the bolt, movement and realignment of the hand grip 4 with the appropriate height apertures in tubes 3*a* and 3*b* and redeployment of the bolt therethrough and rethreading of wing nut 5 on the extending end of the bolt.

In use, the user places weight on underarm support 2. This weight is transmitted to leg 6 via tube members 3*a* and 3*b*. All of the transmitted weight is supported by connectors 7*a* and 7*b* at their point of intersection between leg 6 and tube members 3*a* and 3*b*.

Figure 2A:
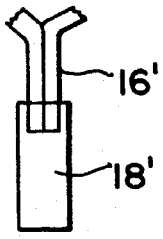
FIG. 2*a* is an alternative construction of the leg portion of the crutch of FIG. 2.
Figure 2:
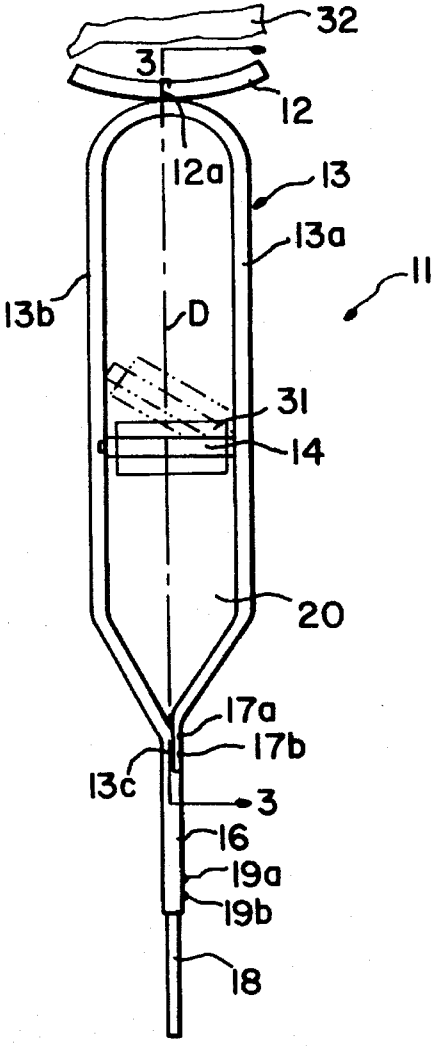
FIG. 2 is a front view of a crutch for use with the hand grip of the present invention.

The weight supporting body 13 of crutch 11 shown in FIG. 2, is comprised of a single tubular member bent into a closed ovate structure 20 with spaced parallel sides 13*a* and 13*b*. Side 13*b* unitarily continues beyond the periphery of the ovate structure into extension leg element 16. Extension element 16 is substantially in line with major axis D of ovate structure 20. End 13*c* of the tubular member is compressed together, while maintaining its original curvature whereby it is fitted on extension element 16 and riveted thereto by rivets 17*a* and 17*b*. Adjustable leg 18 of smaller diameter than the extension element 16 is fitted therewithin and is adjustably held by button elements 19*a* and 19*b*, which extend through corresponding apertures in extension element 16.

In an alternate construction, as shown in FIG. 2*a*, extension element 16' can be comprised of abutted hemispherical ends of parallel sides 13*a* and 13*b*. In this embodiment leg element 18' is of larger diameter than extension element 16' and is fitted over the extension element.

Underarm support 12 is a separate element, which, as shown more clearly in FIG. 3, is fitted into a partial compression of the tubular member and riveted thereto by rivet 12*a*. Rivet 12*a* is preferably in line with major axis D (with the weight vector passing downward through this axis) whereby peripheral weight shearing stress is minimized.

Figure 4:
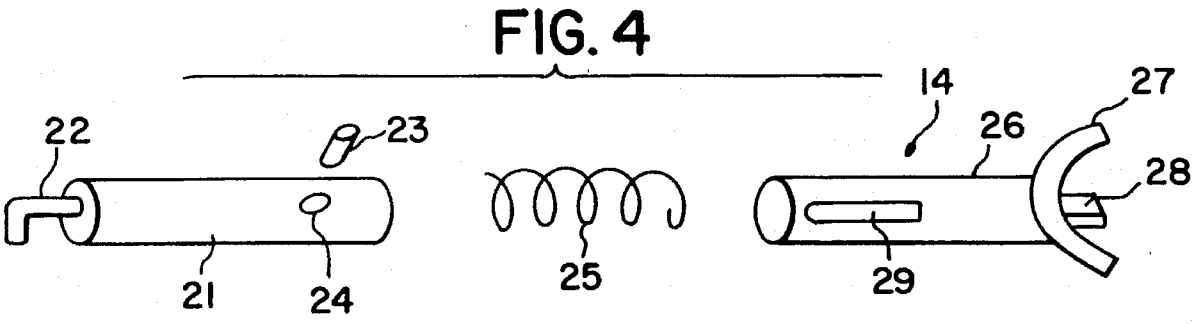
FIG. 4 is an exploded view of an adjustable hand grip.

The adjustable hand grip 14 of the present invention, as more clearly seen in the exploded view of FIG. 4, is comprised of tubular member 21 having a closed end which supports hook element 22. Spring 25 is inserted into tubular member 21 and plastic Y-shaped member 26 is inserted into tubular member 21 to compress spring 25. Rivet 23 fits within aperture 24 (and corresponding exit aperture (not shown) of tubular member 21. Rivet 23 also engages slot 29 of Y-shaped member 26, whereby it is retained within tubular member 21 with a spring loading. Compression of the Y-shaped member 26 cause the rivet 23 to move within slot 29 to shorten the length of the hand grip 14.

As shown in FIG. 3, parallel side 13*a* comprises a series of spaced apart square apertures 30. Parallel side 13*b* has corresponding apertures (not shown).

The hand grip 14 is adjustably positioned by hooking hook 22 through a selected aperture in either of parallel sides 13*a* or 13*b* with the hook extending along the length of the tube (the curvature of the tube may interfere with a lateral placement of the hook). Y-shaped member 26 is compressed into tubular member 21, while extension rod 28, of square cross-section, is fitted into the appropriate and correspondingly shaped aperture 30. Curved section 27 (the fork of the Y) fittingly engages the curvature of parallel side 13*a* to help guide extension rod 28 into engagement with the aperture 30. In addition, curved section 27 helps maintain the hand grip 14 in non-rotatable engagement with the crutch body 13.

Positioning of the hand grip 14 is shown in standard hand grip position and with dotted lines in inclined position for user comfort as desired. In the latter position the rod 28 and hook 22 are engaged with opposing but offset apertures. The Y-shaped member 26 is preferably comprised of a smooth hard plastic to facilitate its movement within the tubular member 21 and to prevent nicking or marring of the tubular surface.

Figure 5A:
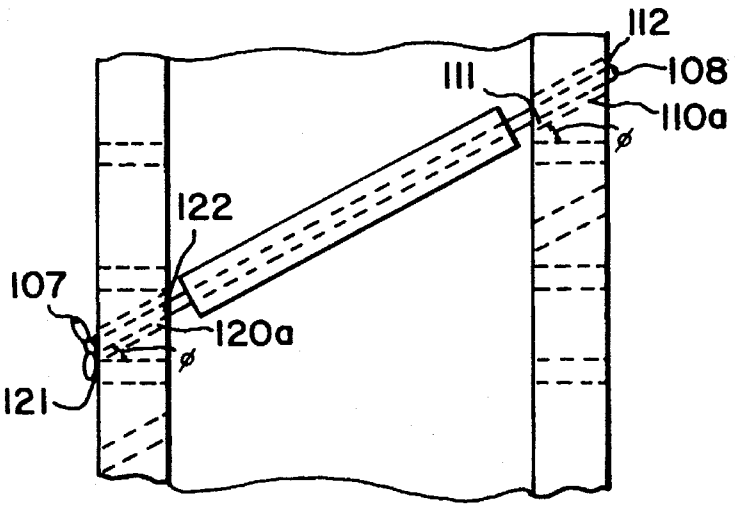
FIG. 5*a* is an enlarged view of portion 5*a* of FIG. 5.
Figure 5:
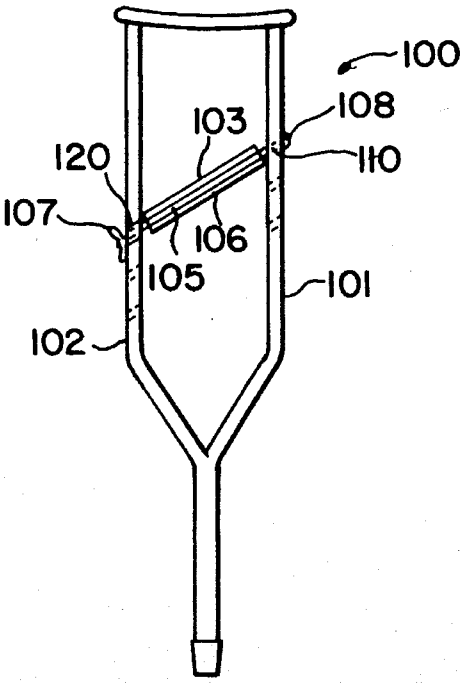
FIG. 5 is a partial sectioned view of an inclined hand grip of the present invention with a bolt support and connection.

In FIG. 5, a crutch 100 is shown having a standard hand grip 103 with a gripping section 106 supported on a bolt 105. As shown, apertures 110 and 120 are angularly offset from level placement, to permit the hand grip 103 to be placed at a downward incline toward aperture 120. Bolt 105 is placed through both apertures 110 and 120 and fixed into position with standard bolt head 108 and wing nut 107. As is more clearly seen in the enlarged view of FIG. 5*a*, apertures 110*a* and 120*a* are offset from level placement by angle $\phi$, with the faces of the apertures 111 & 112 and 121 & 122 being offset from the vertical of the respective crutch sections 101 and 102 by the same angle $\phi$. The angular recess at 122 and 121 with an angled platform surrounding the aperture ends permits bolt head 108 and wing nut 107 to be placed flush with a surface of the respective crutch section 102 and 101.

Figure 6:
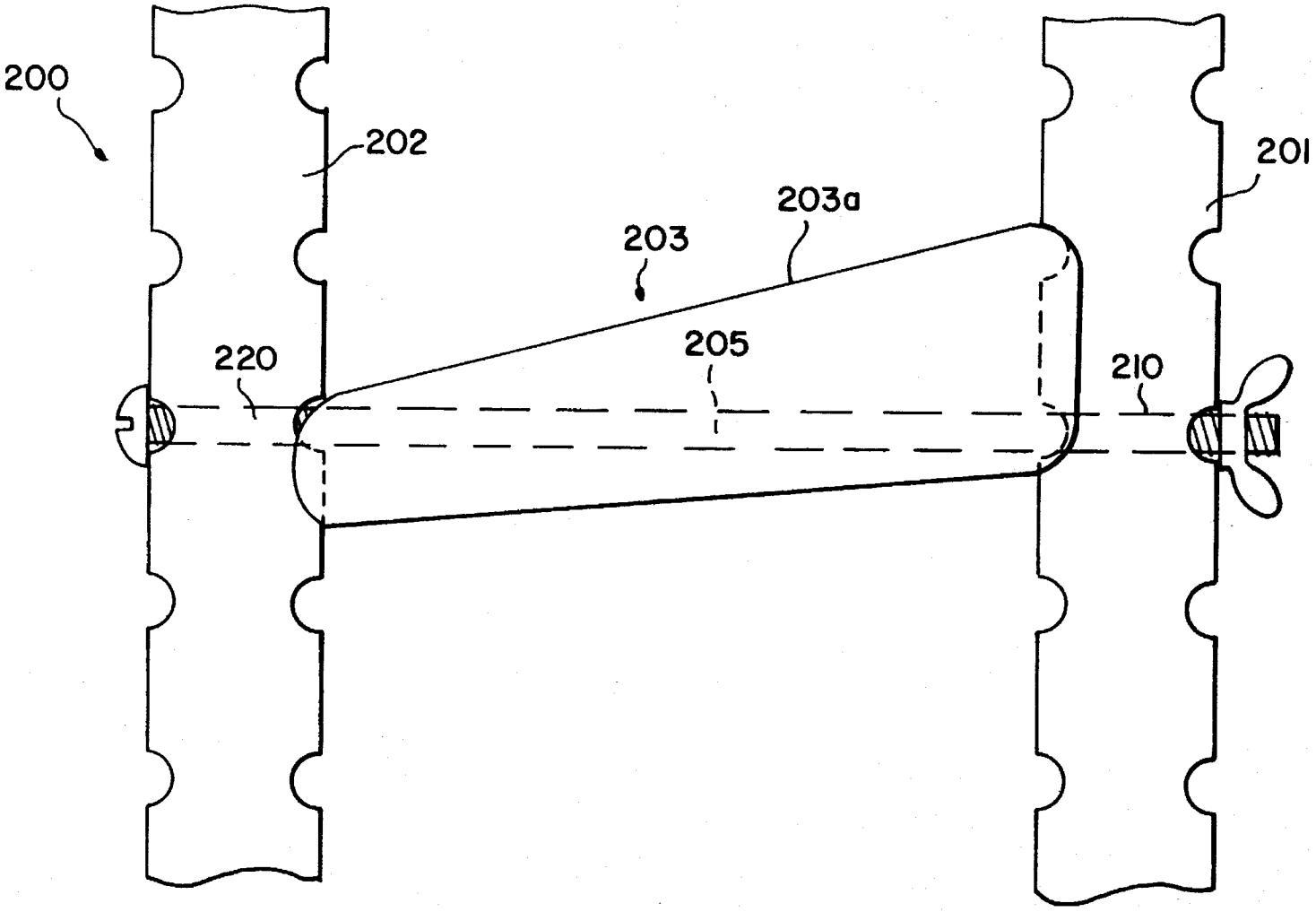
FIG. 6 is a view similar to that of FIG. 5*a* but with a modified hand grip, horizontally affixed, but with an inclined gripping configuration.

In FIG. 6, a standard crutch 200 with laterally aligned apertures 210 and 220 is shown. Hand grip 203 is shown as being affixed to crutch sections 201 and 202 with a standard bolt 205 and wing nut 207 connection placed through laterally aligned apertures 210 and 220. Hand grip 203 is aperture and configured to provide an inclined upper surface 203*a* to provide an inclined hand grip without modification of the crutch.

It is understood that the above description and drawings are illustrative of the present invention and details contained therein are not to be construed as limitations on the present invention. Changes in components and structure may be made without departing from the scope of the present invention as defined in the following claims.

For example, the crutch assembly and components of the invention may be fabricated entirely out of plastics materials by conventional fabrication techniques such as injection molding, hot stamping and the like. Accordingly, the invention is considered to contemplate this aspect within its initial spirit and scope.

What is claimed is:

1. A combination of crutch and adjustable hand grip, with the crutch having two parallel, spaced apart sections which are terminally connected to each other to provide an enclosed area, the spaced apart sections having apertures for positioning and connecting the adjustable hand grip; wherein the hand grip is positioned at an incline with its longitudinal axis contained within the plane containing the parallel sections.

2. The combination of claim 1, wherein the hand grip is adjustably connected to the two parallel, spaced apart sections with a bolt which passes through apertures in each of the spaced apart sections and the hand grip, and wherein said means comprises a predetermination of the extent of the angular offset from the perpendicular plane and wherein the parallel spaced apart sections of the crutch are correspondingly apertured along the angular offset, with said apertures, to permit placement of the bolt through each of the spaced apart sections and the hand grip at the angular offset.

3. The combination of claim 2, wherein the two parallel, spaced apart sections are also apertured along the perpendicular plane whereby the hand grip can be positioned and connected either along the perpendicular plane or along the angular offset.

4. The combination of claim 1, wherein the hand grip is adjustably connected to the two parallel, spaced apart sections with a bolt which passes through the apertures in each of the spaced apart sections and an aperture in the hand grip, with the apertures in the spaced apart sections facing each other in the perpendicular plane and wherein the means comprises an angled configuration of the hand grip when positioned and connected between the spaced apart sections.

* * * * *